US012012735B2

(12) United States Patent
Ahuja

(10) Patent No.: US 12,012,735 B2
(45) Date of Patent: Jun. 18, 2024

(54) BATHTUB OVERFLOW ASSEMBLY

(71) Applicant: PF Waterworks LP, Houston, TX (US)

(72) Inventor: Sanjay Ahuja, Katy, TX (US)

(73) Assignee: PF Waterworks LP, Houston, TX (US)

( * ) Notice: Subject to any disclaimer, the term of this patent is extended or adjusted under 35 U.S.C. 154(b) by 13 days.

(21) Appl. No.: 17/686,740

(22) Filed: Mar. 4, 2022

(65) Prior Publication Data

US 2022/0282466 A1 Sep. 8, 2022

Related U.S. Application Data

(60) Provisional application No. 63/158,331, filed on Mar. 8, 2021.

(51) Int. Cl.
*E03C 1/244* (2006.01)

(52) U.S. Cl.
CPC ..... *E03C 1/244* (2013.01)

(58) Field of Classification Search
CPC ..... E03C 1/232; E03C 1/24; E03C 1/244
See application file for complete search history.

(56) References Cited

U.S. PATENT DOCUMENTS 2,477,478 A * 7/1949 Donahue ..... E03C 1/22 285/191
5,025,509 A * 6/1991 Holt ..... E03C 1/24 4/694
6,073,278 A * 6/2000 Ball ..... E03C 1/24 4/694
6,138,298 A * 10/2000 Ball ..... E03C 1/24 4/694
9,267,274 B2 2/2016 Ball et al.
9,982,424 B1 5/2018 Kuo et al.
10,017,925 B1 7/2018 Kuo
10,240,329 B2 3/2019 Beck et al.
10,301,803 B2 5/2019 Beck et al.
10,329,752 B2 6/2019 Ball
10,443,220 B2 10/2019 Ball et al.
10,544,572 B2 1/2020 Humber et al.
10,563,385 B1 2/2020 Ball et al.
10,927,534 B2 2/2021 Gross et al.
11,162,251 B2 11/2021 Beck et al.
11,466,439 B1 * 10/2022 Kuo ..... E03C 1/244
2009/0249542 A1 * 10/2009 Uhl ..... E03C 1/24 4/694

(Continued)

*Primary Examiner* — Erin Deery
(74) *Attorney, Agent, or Firm* — Stephen S. Hodgson

(57) ABSTRACT

A bathtub overflow assembly comprises a holder and a faceplate that attaches to the holder using a snap-fit or threaded connection. The holder has rectangular shape, a length greater than the diameter of a bathtub overflow port and pass-through screw holes for attachment to an overflow fitting. The holder has a pair of posts that project from an outer surface, and each post has a shoulder near a distal end for the snap-fit connection. The faceplate has walls that project from an inner surface, and the walls have openings for receiving the shoulders for the snap-fit connection. The holder is attached to the overflow fitting using one or more screws, and the faceplate is pressed into engagement with the holder for the snap-fit connection. For the threaded connection, the holder has a central threaded tube, and the faceplate has a threaded element that engages the tube by rotating the faceplate.

27 Claims, 8 Drawing Sheets

(56) References Cited

U.S. PATENT DOCUMENTS

| | | | | |
|---|---|---|---|---|
| 2017/0335554 | A1* | 11/2017 | Kuo | E03C 1/24 |
| 2019/0167043 | A1 | 6/2019 | Beck et al. | |
| 2020/0011038 | A1 | 1/2020 | Ahuja et al. | |
| 2021/0207351 | A1 | 7/2021 | Ahuja et al. | |
| 2021/0395985 | A1* | 12/2021 | Hsu | E03C 1/24 |

* cited by examiner

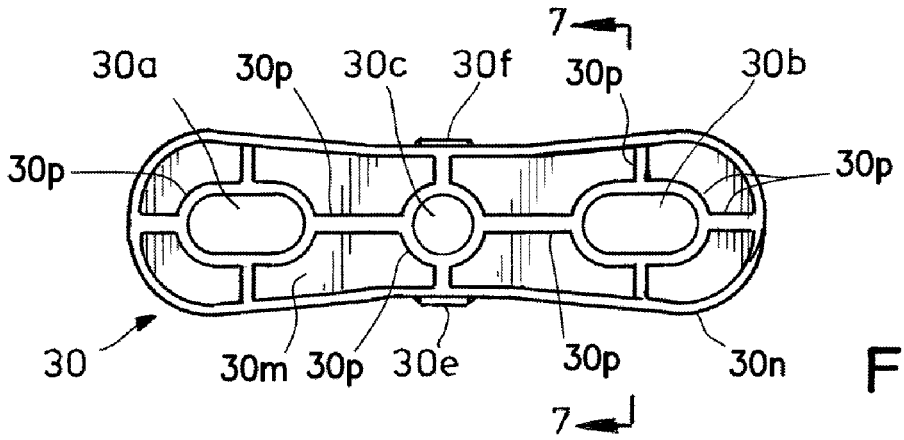
FIG. 4
FIG. 7
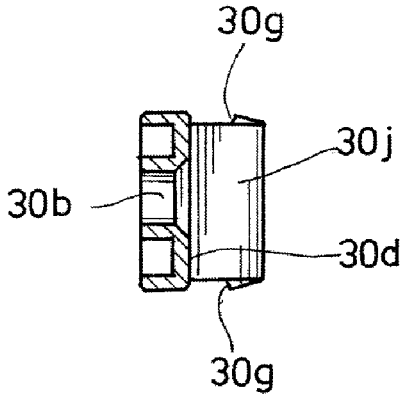
FIG. 5
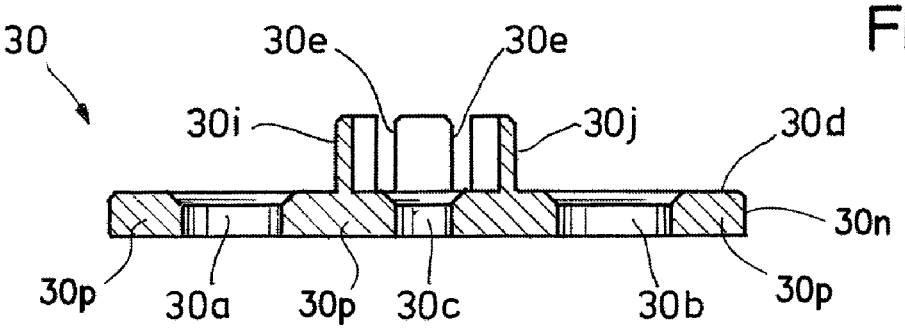

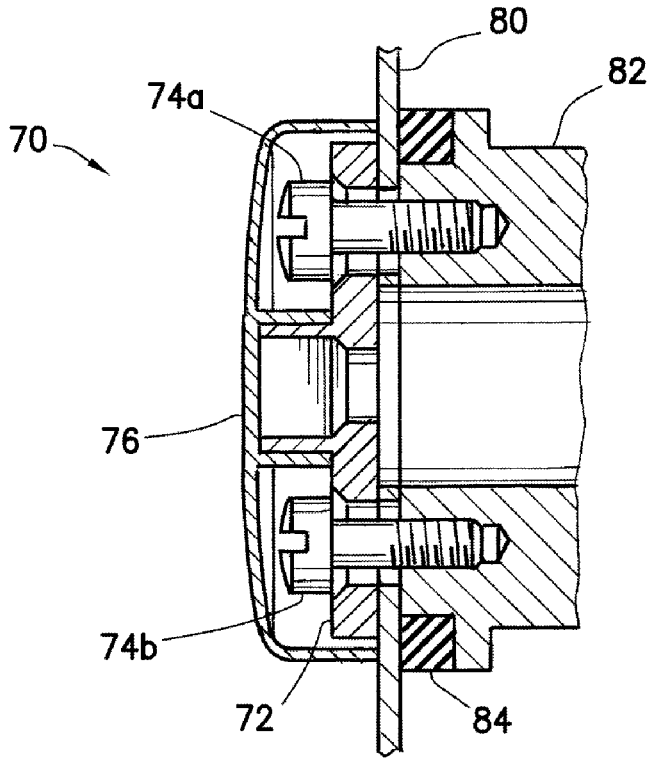
FIG.14
FIG.15
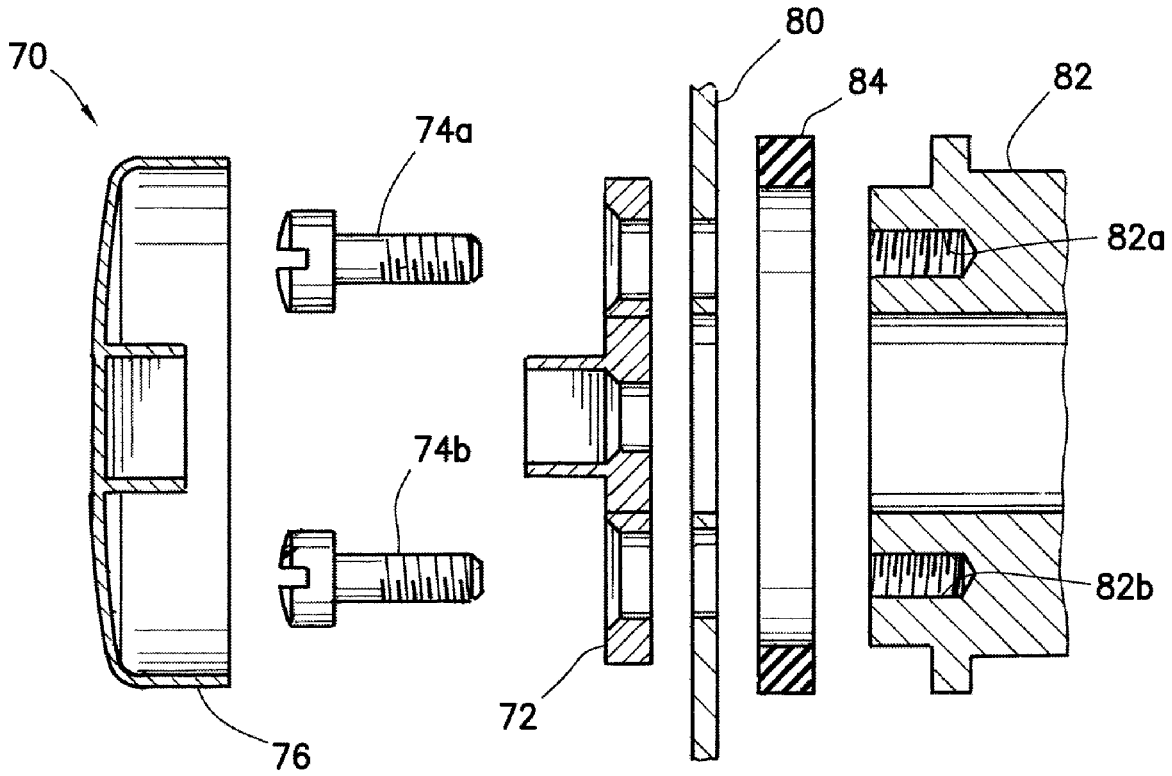

BATHTUB OVERFLOW ASSEMBLY

CROSS REFERENCE TO RELATED APPLICATIONS

This application claims priority to and the benefit of U.S. Provisional Patent Application Ser. No. 63/158,331 filed on Mar. 8, 2021, which is incorporated by reference.

BACKGROUND OF THE INVENTION

1. Field of the Invention

This present invention pertains to a bathtub drain and overflow system and more particularly to a bathtub overflow assembly.

2. Description of the Related Art

Water drains from a bathtub through a bathtub drain system or assembly. The bathtub has a drain opening. The drain system includes an L-shaped drain pipe, which is sometimes referred to as a bathtub drain shoe and which includes a 90-degree elbow that has female threads on one end and a length of drain pipe on the other end. The female threads of the elbow is placed below the drain opening. A short piece of pipe that has male threads on a lower end and a radially-extending flange on the upper end is referred to as a drain body or a drain basket or a drain flange. The lower end of the drain flange is passed through the drain opening in the bathtub, and the flange end remains above and surrounds the drain opening. Plumber's putty can be used around the underside of the flange to provide a seal against the bathtub. The male threads are screwed into the female threads of the elbow to provide a drainage flow path. A washer or a gasket may be used around the male threads adjacent to the underside of the bathtub. The elbow may have a radially-extending flange that presses against the washer or gasket or underside of the bathtub as the male threads of the drain body are screwed into the female threads of the elbow.

A bathtub typically has an overflow port some distance above the bottom inside surface of the bathtub and some distance below an upper edge of the bathtub. The drain opening is typically near one end of a standard bathtub, and the overflow port is typically near the drain opening. An overflow fitting, typically an elbow, is placed outside the bathtub around the overflow port, and a faceplate is placed inside the bathtub and fastened to the overflow fitting for sealing the overflow fitting to the outside of the bathtub at the overflow port. One or two screws are typically used to fasten the faceplate to the overflow fitting.

A problem can arise when one wishes to change the appearance of the faceplate, such as changing one finish for a different finish. One may not be able to readily find an exact replacement faceplate in the desired finish.

SUMMARY OF THE INVENTION

The present invention provides a bathtub overflow assembly, which includes a holder for attachment to an overflow fitting and a faceplate that attaches to the holder using a snap-fit connection or a threaded connection, where a screw is not used to attach the faceplate to the holder. The holder is preferably elongate and rectangular or oval in shape and has a length greater than the diameter of an overflow port in a bathtub. The holder is preferably fastened to the overflow fitting using one or more screws. The holder preferably has a first part of a snap-fit connection, and the faceplate preferably has a second part of the snap-fit connection. The faceplate is pressed into engagement with the holder for the snap-fit connection. The holder preferably has a pair of posts that project perpendicularly out of an outer surface of the holder. Each post preferably has a shoulder near a free end of the post. The faceplate preferably has a pair of walls, where each wall has an opening designed, configured and sized to receive a respective shoulder for engaging the faceplate with the holder in a snap-fit engagement. Alternatively, each of the holder and the faceplate preferably has a threaded element, where the faceplate is attached to the holder by placing the threaded elements together and rotating the faceplate with respect to the holder.

A bathtub drain and overflow assembly includes a drain pipe having a drain elbow, a drain flange sized for receipt in the drain elbow, an overflow pipe having an overflow fitting on one end, a tee fitting for receiving the drain pipe and the overflow pipe, and the bathtub overflow assembly kit described in the paragraph above.

BRIEF DESCRIPTION OF THE DRAWINGS

A better understanding of the invention can be obtained when the detailed description of exemplary embodiments set forth below is considered in conjunction with the attached drawings, which can be described as follows.

FIG. 4 is a bottom plan view of the holder of FIG. 2.

FIG. 5 is a side elevation in cross-section of the holder as seen along the line 5-5 in FIG. 3.

FIG. 7 is a side elevation in cross-section of the holder as seen along the line 7-7 in FIG. 4.

FIG. 14 is a side elevation in partial cross-section of a holder attached to an overflow fitting and a faceplate attached to the holder, according to the present invention.

FIG. 15 is an exploded view of the components shown in FIG. 14.

DETAILED DESCRIPTION OF THE EXEMPLARY EMBODIMENTS

Figure 1:
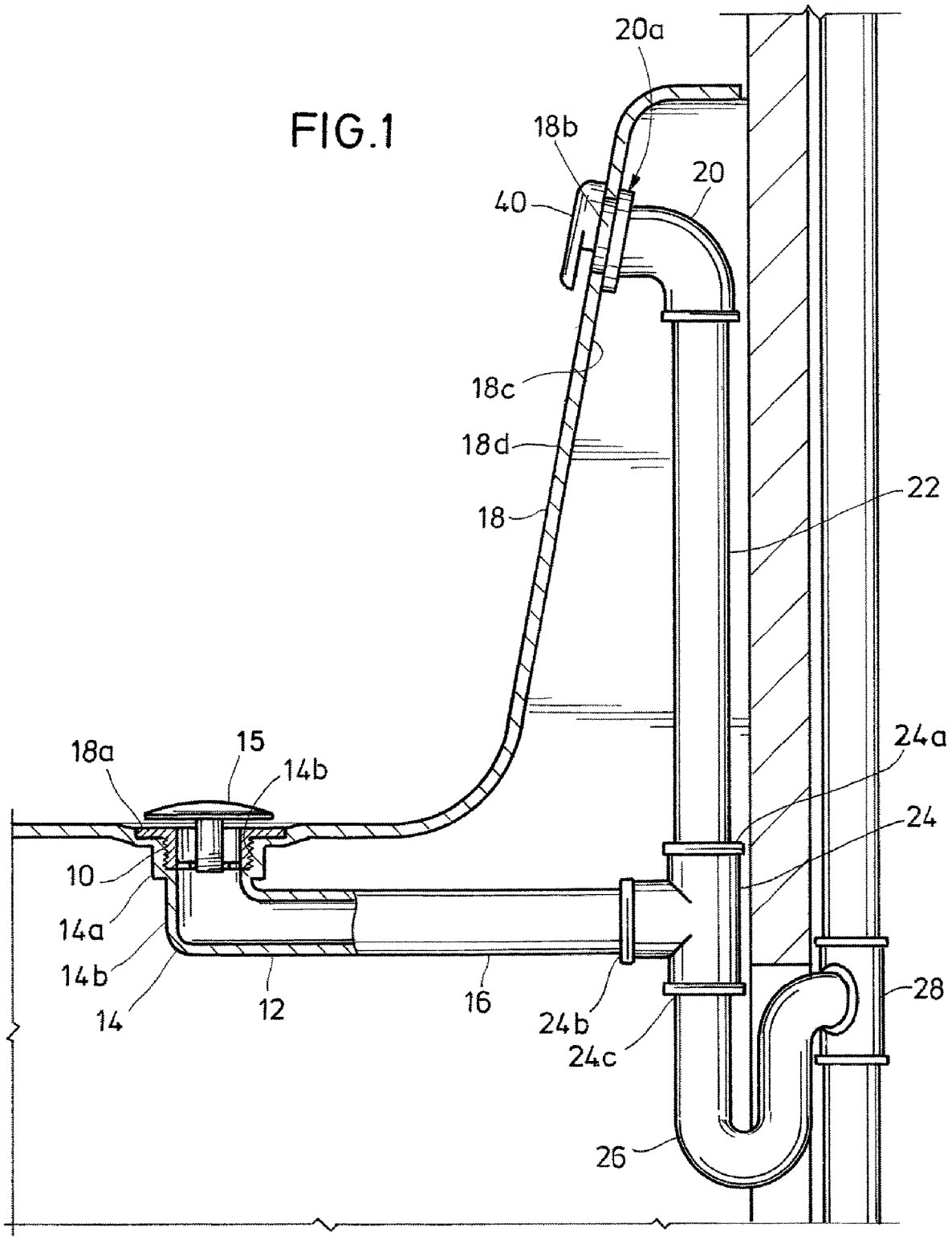
FIG. 1 is a side elevation in partial cross-section of a bathtub fitted with a bathtub drain and overflow system, according to the present invention.

FIG. 1 is a side elevation in partial cross-section of a bathtub drain flange fitting 10 in a threaded engagement with a bathtub drain shoe 12 that comprises a 90-degree elbow 14 formed integral with or attached to a drain pipe 16. A partial view in cross-section of a bathtub 18 shows a drain opening 18*a* and an overflow port 18*b*. The bathtub drain flange fitting 10 is received in the drain opening 18*a*, and a drain stopper 15 is received in the bathtub drain flange fitting 10. An overflow fitting 20 is connected to an overflow pipe 22, which is connected to a tee 24. Tee 24 has an upper opening 24*a* for receiving the overflow pipe 22, a side opening 24*b* for receiving the drain pipe 16 and an outlet 24*c* connected to a drain trap 26, which is connected to a plumbing system 28.

The overflow fitting 20 in FIG. 1 is attached to the bathtub 18 at the overflow port 18*b*. A gasket 20*a* provides a seal between an external surface 18*c* of the bathtub 18 and the overflow fitting 20. A holder 30, which is not visible in FIG. 1, is attached to the overflow fitting 20 by one or two screws, as described further in the paragraphs below, particularly with reference to FIGS. 1A, 1B, 14 and 15. The holder 30 has a length that is greater than the diameter of the overflow port 18*b*. The holder 30 presses against an inside surface 18*d* of the bathtub 18. The one or two screws have external threads, and the overflow fitting 20 has one or two bores that are defined by internal threads. The screws pass through the holder 30 and are threaded and tightened into the bores, which fastens the overflow fitting 20 to the bathtub 18 and presses the gasket 20*a* against the outside surface 18*c* of the bathtub 18 to provide a seal between the overflow fitting 20 and the bathtub 18. A faceplate 40 is attached to the holder 30 with a snap-fit connection assembly for covering and hiding the holder 30 and the overflow port 18*b*.

Figure 1B:
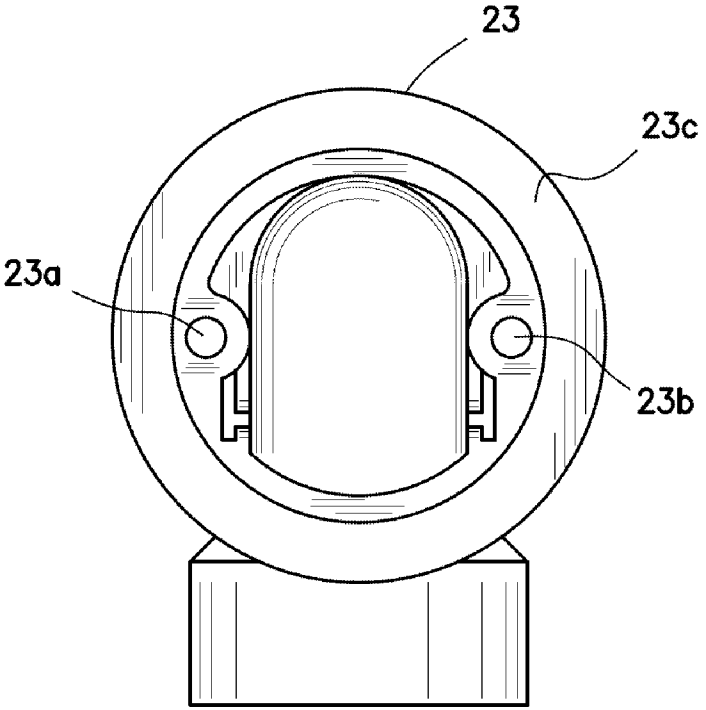
FIG. 1B is a side elevation of a bathtub overflow fitting that has two threaded bore holes.
Figure 1A:
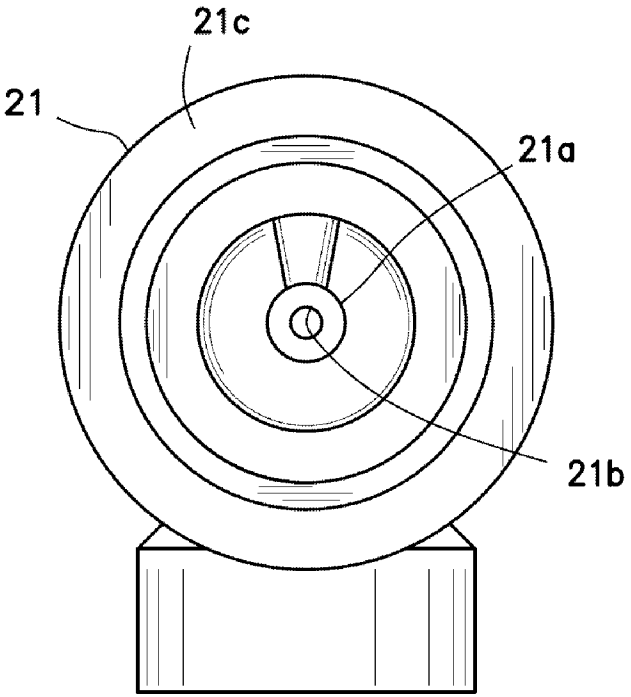
FIG. 1A is a side elevation of a bathtub overflow fitting that has one central threaded bore hole.

FIG. 1A is a side elevation of an overflow fitting 21 as seen from looking into an opening that is connected to a bathtub at its overflow port. Overflow fitting 21 has a central tubular shaft 21*a*, which has a longitudinal bore 21*b* defined by internal threads. A screw is received in bore 21*b* for fastening overflow fitting 21 to a bathtub, as will be explained further below. Overflow fitting 21 has a flange 21*c* for receiving a gasket for sealing overflow fitting 21 to a bathtub. FIG. 1B is a side elevation of an overflow fitting 23 as seen from looking into an opening that is connected to a bathtub at its overflow port. Overflow fitting 23 has two screw holes 23*a* and 23*b* for receiving two screws for fastening overflow fitting 23 to a bathtub, as will be explained further below. Overflow fitting 23 has a flange 23*c* for receiving a gasket for sealing overflow fitting 23 to a bathtub. Overflow fittings 21 and 23 are two standard types of overflow fittings that are commonly used. In the prior art, a faceplate with one screw hole is used with overflow fitting 21, and a faceplate with two screw holes is used with overflow fitting 23.

Figure 2:
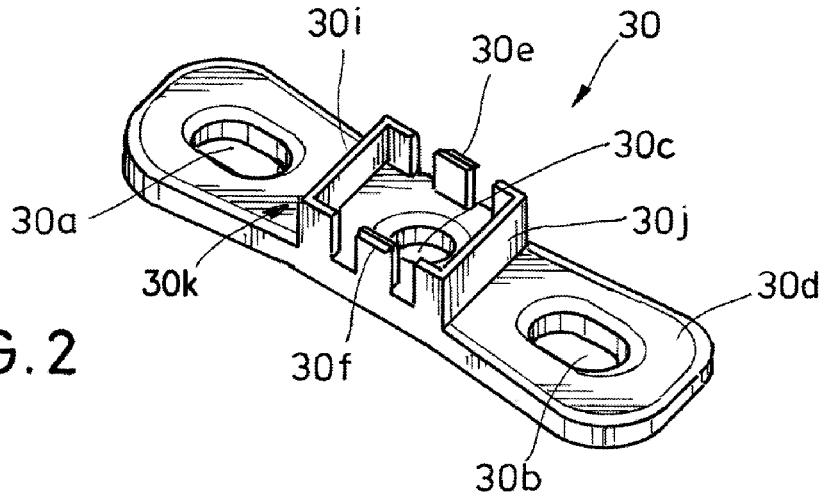
FIG. 2 is a perspective view of a holder, according to the present invention.

FIG. 2 is a perspective view of the holder 30. Holder 30 has an elongated oval shape and a longitudinal length that is greater than the diameter of the overflow port 18*b* so that the holder 30 can abut the inner surface 18*d* of the bathtub 18 for fastening the overflow fitting 20 to the bathtub 18. Holder 30 has three holes 30*a*, 30*b* and 30*c*, which are sized and designed to allow the shank of a screw to pass through the holes while retaining the head of the screw on an upper or outer surface 30*d* of the holder 30. Holes 30*a* and 30*b* are located near opposing ends of the holder 30 and have elongated oval shapes, which accommodates different spacings between threaded bores in the overflow fitting 20. Hole 30*c* is located in the center of holder 30 and is a circular hole. Some standard overflow fittings have one central threaded bore, as shown in FIG. 1A, and another standard overflow fitting has two threaded bores, as shown in FIG. 1B. Two screws are passed through the holes 30*a* and 30*b* for an overflow fitting with two threaded bores. One screw is passed through hole 30*c* for an overflow fitting with one threaded bore. The screw or screws are threaded into the bore or bores 20*b* and tightened to fasten the overflow fitting 20 to the bathtub 18. An example with two screws 74*a* and 74*b* is described below with reference to FIGS. 14 and 15.

Figure 6:
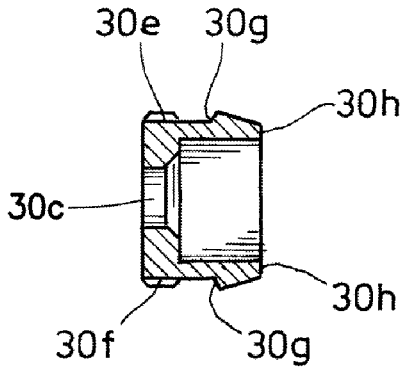
FIG. 6 is a side elevation in cross-section of the holder as seen along the line 6-6 in FIG. 3.
Figure 3:
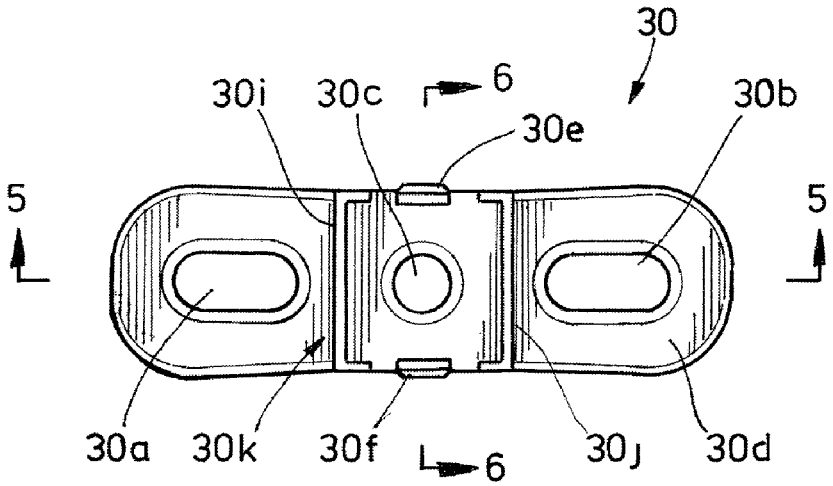
FIG. 3 is a top plan view of the holder of FIG. 2.

FIG. 3 is a top plan view of holder 30. FIG. 4 is a bottom plan view of holder 30. FIG. 5 is a side elevation of holder 30 in cross-section as seen along the line 5-5 in FIG. 3. FIG. 6 is a cross-section of holder 30 as seen along the line 6-6 in FIG. 3. FIG. 7 is a cross-section of holder 30 as seen along the line 7-7 in FIG. 4. Holder 30 has two upright, cantilevered posts 30*e* and 30*f* at its center on opposing sides of the central hole 30*c* along the perimeter of the holder 30. The posts 30*e* and 30*f* extend upwardly from the upper or outer surface 30*d*. Posts 30*e* and 30*f* each have a rectangular transverse cross-section and a shoulder 30*g* near a distal end 30*h*. The shoulders 30*g* can be best seen in FIG. 6. The shoulders 30*g* and the distal end 30*h* form one-half of an arrowhead because the posts 30*e* and 30*f* are thicker at the shoulder 30*g* than at a point proximal to the upper/outer surface 30*d* of the holder 30. The shoulder 30*g* is defined by this difference in thickness. The cantilevered posts 30*e* and 30*f* with their shoulders 30*g* are a first part of a snap-fit connection assembly for receiving and holding the faceplate 40. A pair of U-shaped walls 30*i* and 30*j* project upwardly from the upper surface 30*d* on opposing sides of the central hole 30*c*. The posts 30*e* and 30*f* are between and are spaced away from the walls 30*i* and 30*j*. The posts 30*e* and 30*f* and the walls 30*i* and 30*j* form a discontinuous box 30*k* in the center of the holder 30 surrounding the central hole 30*c*. The box 30*k* provides a means for centering a second part of the of the snap-fit connection assembly, which is on the faceplate 40. The bottom plan view of holder 30 in FIG. 4 shows a lower or inner surface 30*m*, a perimeter wall 30*n* and reinforcing ribs 30*p*. A relatively thin sheet is defined between the upper surface 30*d* and the lower surface 30*m* relative to the perimeter wall 30*n* being thicker. The perimeter wall 30*n* and the reinforcing ribs 30*p* preferably have the same thickness. The reinforcing ribs 30*p* surround the holes 30*a*, 30*b* and 30*c*. Segments of the reinforcing ribs 30*p* extend between the holes 30*a*, 30*b* and 30*c* and the perimeter wall 30*n*, and other segments extend between the holes. The reinforcing ribs 30*p* add structural strength to the holder 30. Holder 30 could be made as an open structure having the shape shown in FIG. 4 for the reinforcing ribs 30*p*, without the sheet defined between the upper surface 30*d* and the lower surface 30*m*, which would provide more open flow area through which overflow water could flow.

Figure 8:
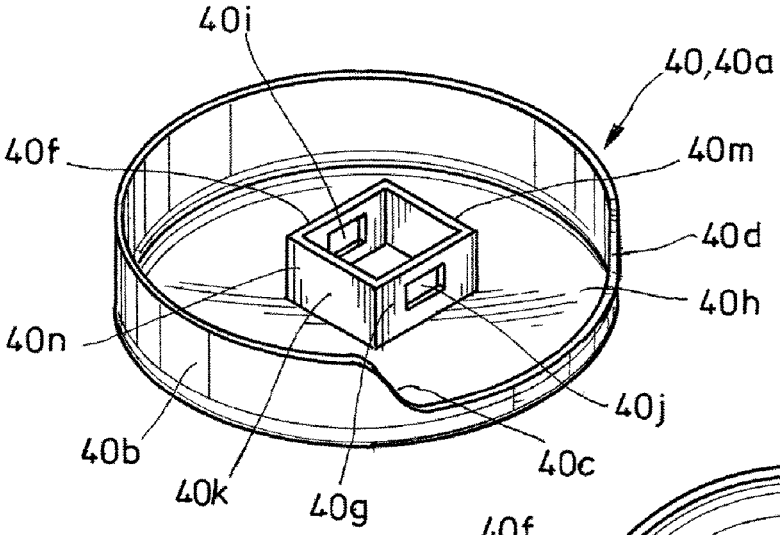
FIG. 8 is a perspective view of a bathtub overflow faceplate, according to the present invention.
Figure 9:
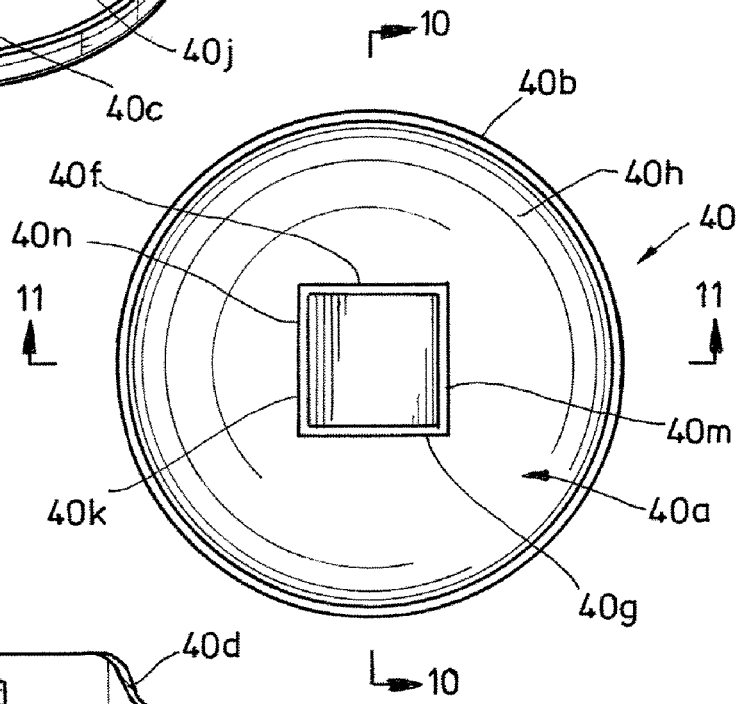
FIG. 9 is a bottom plan view of the faceplate of FIG. 8.
Figure 10:
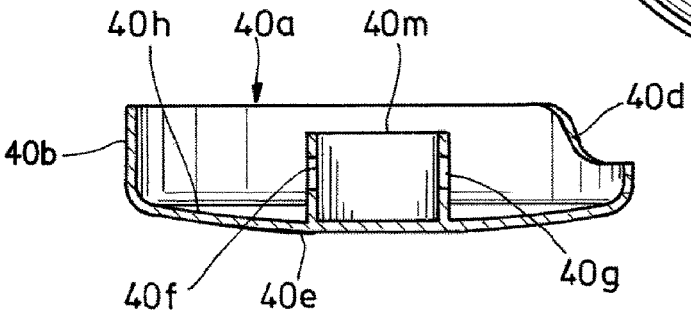
FIG. 10 is side elevation in cross-section of the faceplate as seen along the line 10-10 in FIG. 9.
Figure 11:
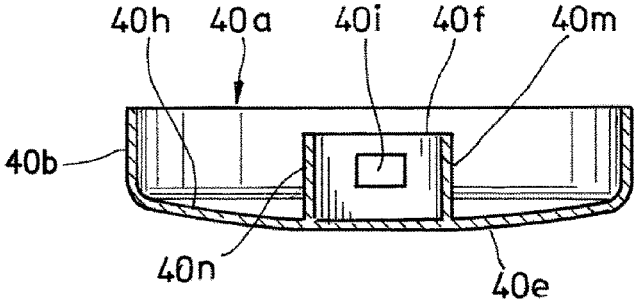
FIG. 11 is side elevation in cross-section of the faceplate as seen along the line 11-11 in FIG. 9.

FIG. 8 is a perspective view of the underside or inside 40*a* of the faceplate 40. FIG. 9 is a bottom plan view of the faceplate 40. FIG. 10 is a cross-section of faceplate 40 as seen along the line 10-10 in FIG. 9. FIG. 11 is a cross-section of faceplate 40 as seen along the line 11-11 in FIG. 9. Faceplate 40 has a perimeter wall 40*b* around about two-thirds or three-fourths of its perimeter. A gap in the wall is defined by edges 40*c* and 40*d* in the perimeter wall 40*b*. The perimeter wall 40*b* spaces the faceplate 40 away from the inner surface 18*d* of the bathtub 18. The gap in the wall 40*b* provides a flow channel for water to overflow from the bathtub 18 into the overflow fitting 20 for preventing or reducing overflow from the bathtub 18 in the event that the drain opening 18*a* is stoppered and sealed while water continues to flow into the bathtub 18. FIGS. 10 and 11 show the inside 40*a* and an opposing outside 40*e* of faceplate 40.

The second part of the of the snap-fit connection assembly comprises a pair of opposing walls 40*f* and 40*g* that project from an under surface 40*h* of the faceplate 40. The wall 40*f* has a rectangular opening 40*i*, and the wall 40*g* has a rectangular opening 40*j*. The second part of the of the snap-fit connection assembly preferably includes opposing walls 40*m* and 40*n*, which connect with the walls 40*f* and 40*g* to form a box 40*k*.

After the holder 30 is fastened to the overflow fitting 20, its box 30*k* and its posts 30*e* and 30*f* project outwardly away from the inside surface 18*d* of the bathtub 18 around the overflow port 18*b*. One fastens the faceplate 40 by first aligning the faceplate box 40*k* with the holder box 30*k* such that the shoulders 30*g* on posts 30*e* and 30*f* align with the openings 40*i* and 40*j* in walls 40*f* and 40*g*, respectively. One then presses on a central portion of the outside 40*e* of faceplate 40, which causes the faceplate box 40*k* to slide along the outside of the holder box 30*k*, and the cantilevered posts 30*e* and 30*f* flex or bend inwardly as the shoulders 30*g* ride along the walls 40*f* and 40*g* until the shoulders 30*g* snap into the openings 40*i* and 40*j*, respectively, thereby fastening the faceplate 40 to the holder 30.

Figure 12:
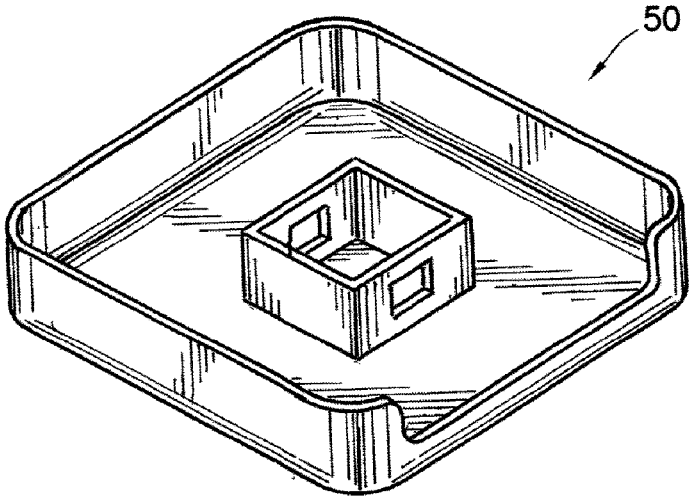
FIG. 12 is a perspective view of a bathtub overflow faceplate, according to the present invention.

FIG. 12 is a perspective view of the underside or inside of a faceplate 50, which is an alternative embodiment of faceplate 40. Faceplate 50 corresponds in all aspects with faceplate 40, except the perimeter of faceplate 50 in FIG. 12 is square with rounded corners rather than circular. This is merely an aesthetic difference. Faceplate 50 functions in the same manner as described above for faceplate 40 in FIGS. 8-11.

Figure 13:
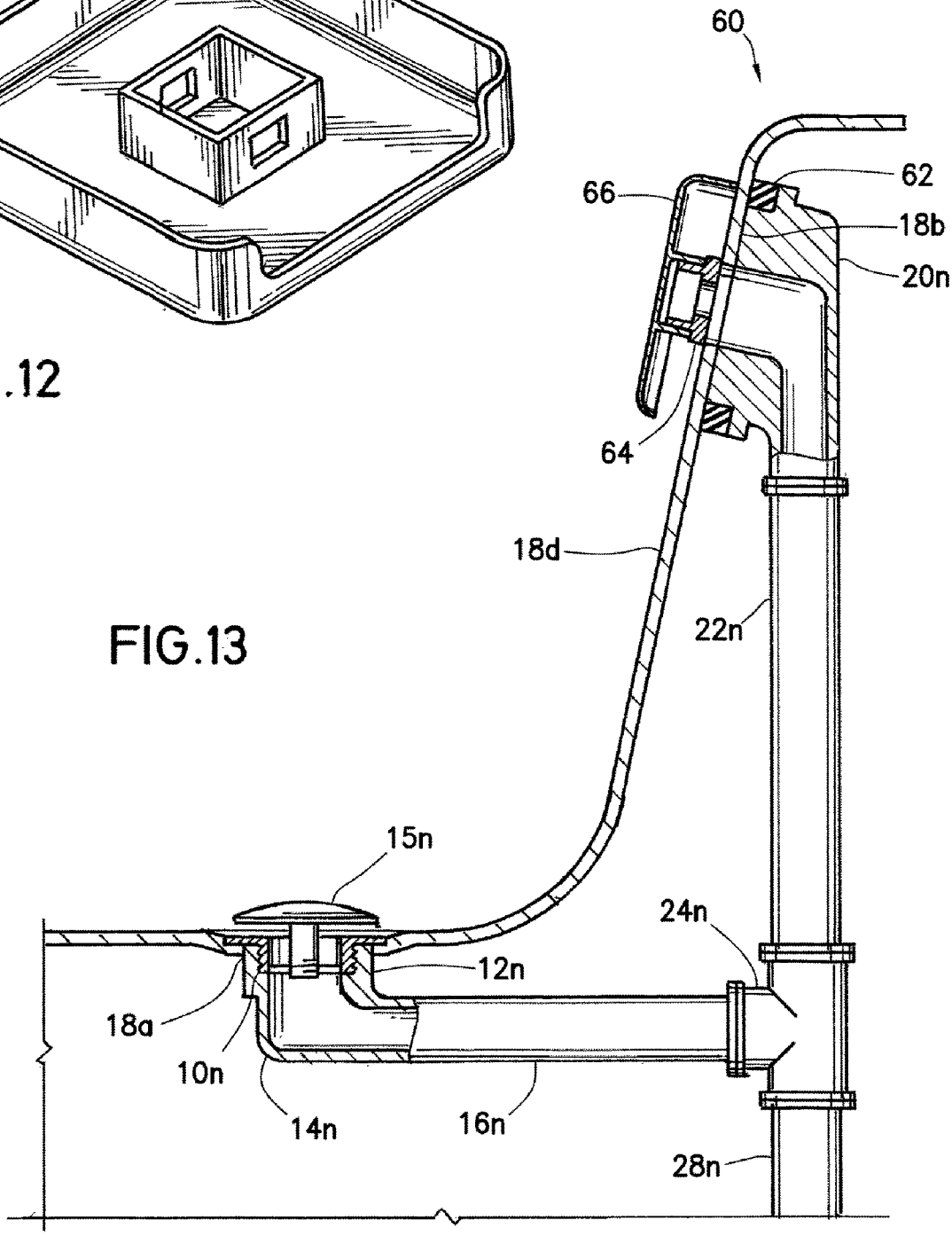
FIG. 13 is a side elevation in partial cross-section of a bathtub fitted with a bathtub drain and overflow system, according to the present invention.

FIG. 13 is a side elevation in cross section of a bathtub overflow assembly 60, according to the present invention, installed in the bathtub 18 of FIG. 1. With reference to FIG. 1, a partial view in cross-section of the bathtub 18 shows the drain opening 18*a* and the overflow port 18*b*. An overflow fitting 20*n* is connected to an overflow pipe 22*n*, which is connected to a tee 24*n*, which is connected to a plumbing system 28*n*. The bathtub overflow assembly 60 is attached to the bathtub 18 at the overflow port 18*b*. A bathtub drain flange fitting 10*n* is received in the bathtub drain opening 18*a* and is in a threaded engagement with a bathtub drain shoe 12*n* that comprises a 90-degree elbow 14*n* formed integral with or attached to a drain pipe 16*n*, which connects to the tee 24*n*. A drain stopper 15*n* is received in the bathtub drain flange fitting 10*n*. A gasket 62 provides a seal between an external surface 18*c* of the bathtub 18 and the overflow fitting 20*n*. A holder 64 is attached to the overflow fitting 20*n* by one or two screws, which are not visible in FIG. 13. The holder 64 has a length that is greater than the diameter of the overflow port 18*b*. The holder 64 presses against the inside surface 18*d* of the bathtub 18. A faceplate 66 is attached to the holder 64 with a snap-fit connection assembly for covering and hiding the holder 64 and the overflow port 18*b*.

FIG. 14 is a cross section of a bathtub overflow assembly 70, according to the present invention, installed in a bathtub 80 and connected to an overflow fitting 82. FIG. 15 is an exploded view of the components shown in FIG. 14. Overflow fitting 82 has bore holes 82*a* and 82*b* defined by internal threads. A holder 72 having the design characteristics described with reference to FIGS. 2-7 is fastened to the overflow fitting 82 using screws 74*a* and 74*b*. Screws 74*a* and 74*b* have external threads that threadedly engage the internal threads that define the bore holes 82*a* and 82*b* in the overflow fitting 82. A gasket 84 provides a seal between the overflow fitting 82 and an outside surface of the bathtub 80. A faceplate 76 having the design characteristics described with reference to FIGS. 8-11 is fastened to the holder 72 by the snap-fit connection described above with reference to FIGS. 8-11.

Alternative embodiments of the snap-fit connection assembly are available. A snap-fit connection assembly typically uses flexible parts, such as a plastic, to connect two parts together by pushing the parts' interlocking components together. Holder 72 is preferably made of a plastic material, and faceplate 76 is preferably made of a metal material. The snap-fit connection described for connecting faceplate 76 to holder 72 is known as a cantilever type of snap-fit connection. Two other types of snap-fit connections are annular and torsional. An example of an annular snap-fit connection is a snap fastener used to fasten two pieces of cloth together rather than using a button. The box 30*k* shown in FIGS. 2 and 3 could be replaced with a circular wall, preferably having a protuberance near the surface 30*d*. The box 40*k* shown in FIG. 8 could be replaced with a circular wall having a diameter slightly less than the diameter of the circular wall on the holder, preferably with a slight protuberance on a distal end. Upon pressing the faceplate into engagement with the holder, the holder wall would expand slightly to accept the protuberance on the faceplate wall until the protuberance on the faceplate wall snaps into a recess at the protuberance on the holder wall. A ball-and-socket connection can also be an annular snap-fit connection. U.S. Pat. No. 10,686,648 to Beck et al. is incorporated by reference to provide more information about snap-fit connections. For the torsional type of snap-fit connection, the holder (or the faceplate) can have the box 30*k* or the circular wall of the annular snap fit. Another wall is provided that circumscribes the wall on the holder, but is spaced a slight distance away so that an annulus is defined between the two walls. The faceplate (or the holder) has a wall sized and designed to fit snugly in the annulus, thereby providing a friction fit or interference fit that fastens the faceplate to the holder.

Figure 16:
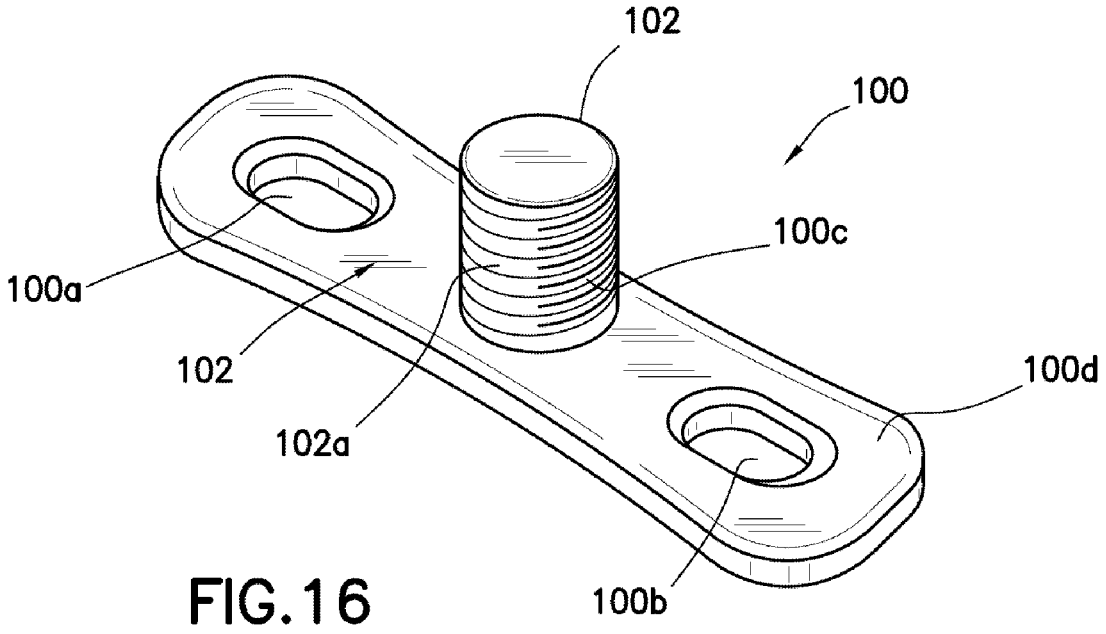
FIG. 16 is a perspective view of an alternative embodiment of a holder, according to the present invention.

FIG. 16 is a perspective view of an alternative holder 100. Holder 100 has an elongated oval shape and a longitudinal length that is greater than the diameter of an overflow port in a bathtub. Holder 100 has three holes 100*a*, 100*b* and 100*c*, which are sized and designed to allow the shank of a screw to pass through the holes while retaining the head of the screw on an upper or outer surface 100*d* of the holder 100. Holes 100*a* and 100*b* are located near opposing ends of the holder 100 and have elongated oval shapes, which accommodates different spacings between threaded bores in an overflow fitting. Hole 100*c* is located in the center of holder 100 and is a circular hole. The three holes 100*a*, 100*b* and 100*c* serve the same purpose as was described above for holder 30 in FIG. 2. The box 30*k* in FIG. 2 has been replaced with a tube 102 for the holder 100 in FIG. 16. Tube 102 is formed integral with or is attached to holder 100. Tube 102 surrounds the centralized hole 100*c* and is preferably centered on the holder 100. Tube 102 has external threads 102*a*.

Figure 17:
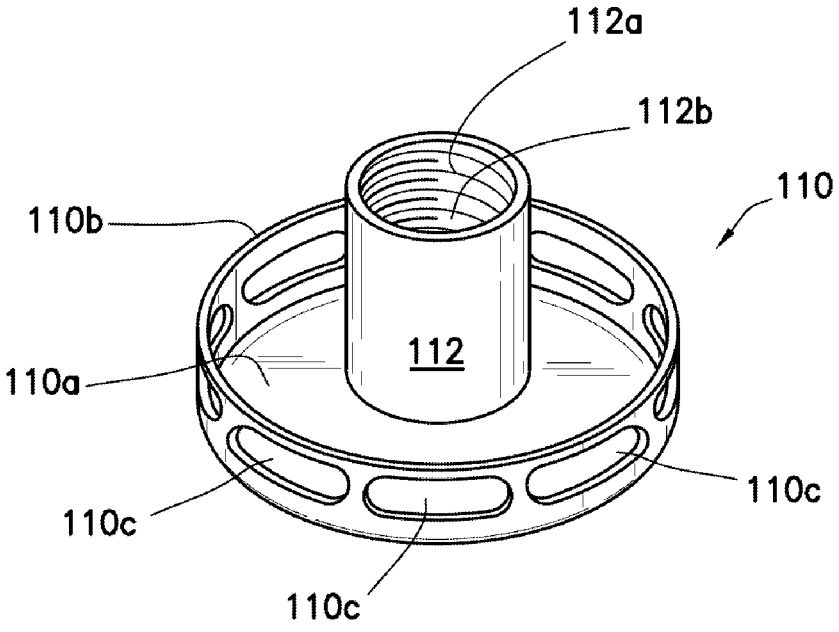
FIG. 17 is a perspective view of an alternative embodiment of a bathtub overflow faceplate, according to the present invention.

FIG. 17 is a perspective view of an underside or inside 110*a* of a faceplate 110. Faceplate 110 has a perimeter wall 110*b*, which has a plurality of oval-shaped openings 110*c* for allowing water to flow into an overflow fitting and drain system. The perimeter wall 110*b* spaces the faceplate 110 away from an inner surface a bathtub. The openings 110*c* in the wall 110*b* provides a flow channel for water to overflow from the bathtub into the overflow fitting for preventing or reducing overflow from the bathtub in the event that a drain opening is stoppered and sealed while water continues to flow into the bathtub. A tube 112 replaces the box 40*k* shown in in FIG. 8. Tube 112 is formed integral with or is attached to the faceplate 110. Tube 112 is preferably centered in the faceplate 110. Tube 112 has internal threads 112*a* that define a bore 112*b*. Tube 112 is designed, sized and configured to threadedly engage the tube 102 on the holder 100. Faceplate 110 is fastened to the holder 100 by screwing the tube 112 onto the tube 102. The threading arrangement can be reversed with tube 112 having external threads and tube 102 having internal threads, in which case tube 112 can be replaced with a solid threaded stud since the hollow tubular structure would not be needed.

The present invention provides an elongate holder that is longer than a diameter of a bathtub overflow port. The holder preferably has at least three holes through which a screw can pass for fastening the holder to an overflow fitting. Two holes, which are located proximal to opposing distal ends of the holder, are used to receive a screw in each for fastening the holder to an overflow fitting that has two holes with internal threads. The screws have external threads that engage the internal threads. For an overflow fitting that has just one bore defined by internal threads, where the bore is centered in an opening of the overflow fitting, one screw is passed through a central opening in the holder for fastening the holder to the overflow fitting. A wall of the bathtub around its overflow port is squeezed between the overflow fitting, which is located outside the bathtub, and the holder, which is located inside the bathtub, by tightening the one or two screws that are passed through the holder and screwed into the overflow fitting. A designer may prefer to use a ribbed structure for the holder, which has a great deal of open area for allowing water to flow through the holder so that the holder impedes water flow as little as possible. A designer may prefer to use a flat bar as the holder. Characteristics of the holder preferably include: (1) a length that is greater than the diameter of the overflow port so that the bathtub wall can be sandwiched between the holder and the overflow fitting; (2) pass-through screw holes for fastening the holder to either an overflow fitting that has one threaded bore hole or to an overflow fitting that has two threaded bore holes; and (3) a means for receiving, engaging and holding a faceplate, where the means is preferably centralized on the holder.

A faceplate is connected to the holder for covering and hiding the overflow port in the bathtub and the holder. The faceplate can have any shape that a designer chooses to use. The faceplate should be designed and configured to allow water to pass though or around the faceplate and into the overflow fitting. The faceplate can be flat with holes or slots or cup-shaped as suggested by the drawings described above. A cup-shaped faceplate comprises a front plate and a perimeter wall. The front plate and/or the perimeter wall can have slots or holes The faceplate is connected to the holder without having screw heads visible from inside the bathtub, which is how faceplates have typically been attached in the prior art.

The holder has a first part of a means for connecting a faceplate to the holder. The faceplate has a second part of a means for connecting a faceplate to the holder. Various snap-fit or interference-fit connection assemblies have been described and suggested above for connecting a faceplate to a holder, thereby describing various means for connecting a faceplate to a holder. A threaded connection has been described above as another means for connecting a faceplate to a holder. The threading arrangement in the threaded connection can be with the holder having internal or external threads, thereby providing more than one means for connecting a faceplate to a holder.

The prior art has some examples of a snap-fit or interference-fit type of connection for a faceplate, but it is believed that such prior art connections provide an engagement around the inside of the perimeter wall of the faceplate. The means for engaging the faceplate with the holder, as described for the present invention above, is located in the center of the faceplate rather than at the perimeter wall. So, in one embodiment of the present invention, there is no engagement between the perimeter wall of the faceplate and the holder, regardless whether such engagement could be an interference-fit or snap-fit or a threaded engagement. However, another embodiment could have the opposing distal ends of the holder engaged with the faceplate with some minor design changes, in which, for example, the distal ends could engage notches on an inside wall of the faceplate or elements similar to the upright, cantilevered posts 30*e* and 30*f* shown in FIG. 2 could be located near or at the opposing distal ends of the holder for engaging a receiving structure in the faceplate or in its perimeter wall.

Other prior art examples do not use the standard overflow fittings shown in FIGS. 1A and 1B. In the present invention, a holder is connected to an overflow fitting that is located entirely outside the bathtub rather than protruding into the bathtub. Some prior art examples have an overflow fitting that protrudes into the bathtub and provides a means for connecting a faceplate to the overflow fitting. The faceplate of the present invention is not connected directly to an overflow fitting and is instead connected to a holder that is located inside the bathtub, and the holder is connected to an overflow fitting, which is located outside the bathtub without any significant protrusion into the bathtub. In one embodiment, the present invention consists of a holder, which can be attached to an overflow fitting located outside of and around a bathtub overflow port, and a faceplate, where the faceplate connects directly to the holder without any connection means being visible to a person looking at the faceplate from inside the bathtub, without any other separate parts being needed to connect the faceplate to the holder, which would then be an indirect connection. The holder is preferably connected directly to an overflow fitting, which would be located entirely outside of a bathtub, preferably by one or more screws, and the faceplate is connected directly to the holder, with the holder having a first part of a means for connecting the faceplate to the holder and the faceplate having a second part of the means for connecting the faceplate to the holder, without any other component being required to fasten the faceplate to the holder or to fasten the holder to the overflow fitting.

Having described the invention above, various modifications of the techniques, procedures, materials, and equipment will be apparent to those skilled in the art. It is intended that all such variations within the scope and spirit of the invention be included within the scope of the appended claims.

What is claimed is:

1. A bathtub overflow assembly comprising:

a holder configured for placement inside a bathtub at an overflow port and for connection to an overflow fitting located outside the bathtub; and a faceplate configured for a direct connection to the holder, wherein the holder has a first part of a means for connecting the faceplate to the holder, wherein the faceplate has a second part of the means for connecting the faceplate to the holder, wherein each of the first and second parts of the means for connecting the faceplate to the holder comprises a rectangular or square box shape, wherein the connection means is centered in the holder and in the faceplate, wherein the connection means is a snap-fit connection in which a center region of the faceplate is pressed against the holder for connecting the faceplate to the holder, wherein the faceplate has an outer surface visible from inside the bathtub, wherein no screw head is visible on the outer surface of the faceplate after assembly, and wherein the faceplate and the holder are designed and configured to allow water in the bathtub to flow through and/or around the faceplate and the holder and into the overflow fitting.

2. The bathtub overflow assembly of claim 1, wherein the holder has one or more holes for receiving one or more screws for attaching the holder to the overflow fitting in a manner such that a wall of the bathtub surrounding the overflow port is squeezed between the holder and the overflow fitting by tightening the one or more screws.

3. The bathtub overflow assembly of claim 2, wherein the holder has an elongate shape, opposing ends and a length that is greater than a diameter of the overflow port, wherein the holder has a center hole centered between the opposing ends of the holder so that one screw can be passed through the center hole for connecting the holder to the overflow fitting, wherein the holder has a second hole proximal to one of the opposing ends and a third hole proximal to the other opposing end, and wherein the holder is designed and configured such that screws can be passed through the second and third holes for connecting the holder to the overflow fitting.

4. The bathtub overflow assembly of claim 1, wherein one of the first and second parts of the means for connecting the faceplate to the holder comprises four continuous walls that form the box shape and the other has four discontinuous walls that form the box shape.

5. The bathtub overflow assembly of claim 1, wherein the faceplate has a perimeter and a perimeter wall around its perimeter, and wherein the perimeter wall is not part of the means for connecting the faceplate to the holder.

6. The bathtub overflow assembly of claim 1, wherein the connection means is a snap-fit connection, and wherein the snap-fit connection is cantilevered, annular or torsional.

7. The bathtub overflow assembly of claim 1, wherein the connection means is a snap-fit connection, wherein the holder has first and second posts that jut toward the faceplate, wherein each of the posts has a shoulder, wherein faceplate has first and second walls that jut toward the holder, wherein each of the walls has an opening, wherein the first and second shoulders are received in the openings in the first and second walls, respectively.

8. The bathtub overflow assembly of claim 1, wherein one part of the means for connecting the faceplate to the holder comprises a post with a narrow tip and a shoulder proximal to the tip, and wherein another part of the means for connecting the faceplate to the holder comprises a receptacle for receiving the post and engaging the shoulder.

9. A bathtub overflow assembly comprising:

a holder designed and configured for attachment to a bathtub overflow fitting at a bathtub overflow port, wherein the holder has a length that is longer than a diameter of the overflow port, wherein the holder has a first hole centered in the holder, a second hole proximal to one end of the holder and a third hole proximal to an opposing end of the holder, wherein the first, second and third holes are sized for a shank of a screw to pass through while a head of the screw does not pass through the holes, and wherein the holder is designed and configured for attachment to the overflow fitting by at least one screw that is passed through the first, second or third hole; and a faceplate configured to be engaged with the holder, wherein the faceplate is designed and sized to cover and hide the holder and the overflow port and to allow water in the bathtub to pass through and/or around the faceplate and into the bathtub overflow fitting, wherein the holder has a first part of a means for connecting the faceplate to the holder, wherein the faceplate has a second part of the means for connecting the faceplate to the holder, wherein the faceplate connects directly to the holder through the means for connecting the faceplate to the holder, wherein the means for connecting the faceplate to the holder is entirely between the faceplate and the holder after the faceplate is attached to the holder and is part of the holder and/or the faceplate, wherein one of the first and second parts of the means for connecting the faceplate to the holder comprises four continuous walls and the other comprises four discontinuous walls, and wherein one of the first and second parts is received in the other first or second part.

10. The bathtub overflow assembly of claim 9, wherein the faceplate has a perimeter and a perimeter wall around its perimeter, and wherein the perimeter wall is not part of the means for connecting the faceplate to the holder.

11. The bathtub overflow assembly of claim 10, wherein the means for connecting the faceplate to the holder is a snap-fit connection in which one presses the faceplate against the holder to fasten the faceplate to the holder.

12. The bathtub overflow assembly of claim 11, wherein the first part of the means for connecting the faceplate to the holder is formed integral with the holder, and wherein the second part of the means for connecting the faceplate to the holder is formed integral with the faceplate.

13. The bathtub overflow assembly of claim 10, wherein the means for connecting the faceplate to the holder is a snap-fit connection in which one Dresses the faceplate against the holder to fasten the faceplate to the holder, wherein one part of the means for connecting the faceplate to the holder comprises a post with a narrow tip and a shoulder proximal to the tip, and wherein another part of the means for connecting the faceplate to the holder comprises a receptacle for receiving the post and engaging the shoulder.

14. The bathtub overflow assembly of claim 10, wherein the part that comprises four discontinuous walls includes two opposing posts that form the discontinuous walls, wherein the posts have shoulders, wherein the part that has four continuous walls has openings in two of the walls for receiving and engaging the shoulders in a snap fit.

15. A bathtub drain and overflow assembly for connecting about a drain hole and an overflow port in a bathtub, the assembly comprising:

a drain pipe for connecting to the bathtub at the drain hole, wherein the drain pipe has a drain elbow on one end that provides a drain opening having internal threads;

a drain flange for receipt inside the bathtub, wherein the drain flange has external threads for engaging with the internal threads in the elbow;

an overflow pipe having an overflow elbow on one end for connecting to the bathtub at the overflow port;

a tee fitting engaged with the drain pipe and the overflow pipe after assembly;

a holder configured to be received inside the bathtub and engaged with the overflow elbow after assembly for fastening the overflow elbow to the bathtub at the overflow port; and a faceplate designed and configured for attachment to the holder, wherein the holder has a first part of a means for connecting the faceplate to the holder, wherein the faceplate has a second part of the means for connecting the faceplate to the holder, wherein the connection means is centered in the holder and in the faceplate, wherein the connection means is a snap-fit connection in which a center region of the faceplate is pressed against the holder for connecting the faceplate to the holder, wherein one of the holder and the faceplate has two posts, wherein each post has a shoulder, and wherein the other of the holder and the faceplate has two walls that have a notch or an opening for receiving the shoulder on one of the posts.

16. The bathtub drain and overflow assembly of claim 15, wherein the faceplate has a perimeter and a perimeter wall around at least a portion of its perimeter, and wherein the perimeter wall is not part of the connection means.

17. The bathtub drain and overflow assembly of claim 15, wherein the faceplate connects directly to the holder without another independent and separate component.

18. The bathtub drain and overflow assembly of claim 15, wherein the holder has a rectangular or an oval shape and at least one hole through which the shank of a screw can pass for fastening the holder to the overflow elbow.

19. The bathtub drain and overflow assembly of claim 15, wherein the holder has an outer surface and the two posts project from the outer surface, and wherein each post has a distal end and the shoulder is proximal to the distal end.

20. The bathtub drain and overflow assembly of claim 19, wherein the faceplate has an inner surface and the two walls project from the inner surface, and wherein two additional walls project from the inner surface of the faceplate, thereby forming a rectangular or square box shape.

21. The bathtub drain and overflow assembly of claim 15, wherein the faceplate comprises four continuous walls, wherein the holder comprises four discontinuous walls, and wherein the four discontinuous walls are received in the four continuous walls.

22. The bathtub drain and overflow assembly of claim 15, wherein the faceplate comprises four walls connected together to form a box including the two walls that have the notch or the opening for receiving the shoulder on one of the posts, and wherein the second part of the means for connecting the faceplate to the holder comprises the box.

23. The bathtub drain and overflow assembly of claim 15, wherein one of the first and second parts comprises four discontinuous walls, wherein the four discontinuous walls include the two posts, wherein the other of the first and second parts has four continuous walls, and wherein the four continuous walls include the two walls that have a notch or an opening.

24. The bathtub drain and overflow assembly of claim 23, wherein the holder comprises the discontinuous walls.

25. The bathtub drain and overflow assembly of claim 24, wherein the discontinuous walls fit inside the continuous walls.

26. The bathtub drain and overflow assembly of claim 15, wherein the holder has a central hole through which threads of a screw can pass but not the head of the screw, and wherein a continuous or discontinuous box is formed around the central opening.

27. The bathtub drain and overflow assembly of claim 15, wherein the holder has a rectangular or oval shape, wherein the holder has a first screw hole centered between opposing ends, a second screw hole proximal to one end and a third screw hole proximal to the other end, wherein the holder has a continuous or discontinuous box surrounding the first screw hole configured to receive a mating continuous or discontinuous box formed integral with the faceplate, wherein one of the holder and the faceplate has the continuous box and the other has the discontinuous box, wherein the discontinuous box comprises the two posts, and wherein the continuous box comprises the wo walls that have the notch or the opening.

* * * * *